US005915974A

United States Patent [19]

Carter

[11] Patent Number: 5,915,974

[45] Date of Patent: Jun. 29, 1999

[54] ROTARY CONNECTOR

[76] Inventor: Huitt G. Carter, 432 N. Virgil, Los Angeles, Calif. 90004

[21] Appl. No.: 09/220,941

[22] Filed: Dec. 24, 1998

[51] Int. Cl.[6] ..... H01R 39/00

[52] U.S. Cl. ..... 439/13; 439/8

[58] Field of Search ..... 439/13, 17, 18, 439/23, 8

[56] References Cited

U.S. PATENT DOCUMENTS

| | | | |
|---|---|---|---|
| 2,231,565 | 2/1941 | Reamer et al. | 439/8 |
| 3,328,741 | 6/1967 | Brown et al. | 439/8 |

FOREIGN PATENT DOCUMENTS

| | | | |
|---|---|---|---|
| 2623145 | 12/1977 | Germany | 439/8 |

*Primary Examiner*—Steven A. Stephan
*Assistant Examiner*—J. F. Duverno

[57] ABSTRACT

A rotary connector for electrically connecting a set of headphones to a portable personal audio device to help prevent stress on the electrical wires of the set of headphones. The rotary connector includes a substantially hemispherical jack socket defining a substantially hemispherical jack space. The outer surface of the jack socket has an annular primary contact therearound. The inner surface of the jack socket has a secondary and tertiary contacts. A resiliently deflectable top cup defines an upper space and has an interior surface with an annular first contact therearound. The top cup has an axial extent outwardly extending from the exterior surface of the top cup with an axial bore extending between the interior and exterior surfaces of the top cup. A generally spherical plug has an outwardly extending axial shaft which inserted into the axial bore of the top cup. The lower region of the plug is inserted into the jack space of the jack socket so that the plug is rotatable in the jack space of the jack socket about the center axis of the plug. The first contact of the top cap and the primary contact of the jack socket abut one another such that the first and primary contacts are in electrically communication with one another. The plug has second and third contacts which abut the secondary and tertiary contacts respectively such that the respect associated contacts are in electrically communication with one another.

9 Claims, 3 Drawing Sheets

FIG. 1
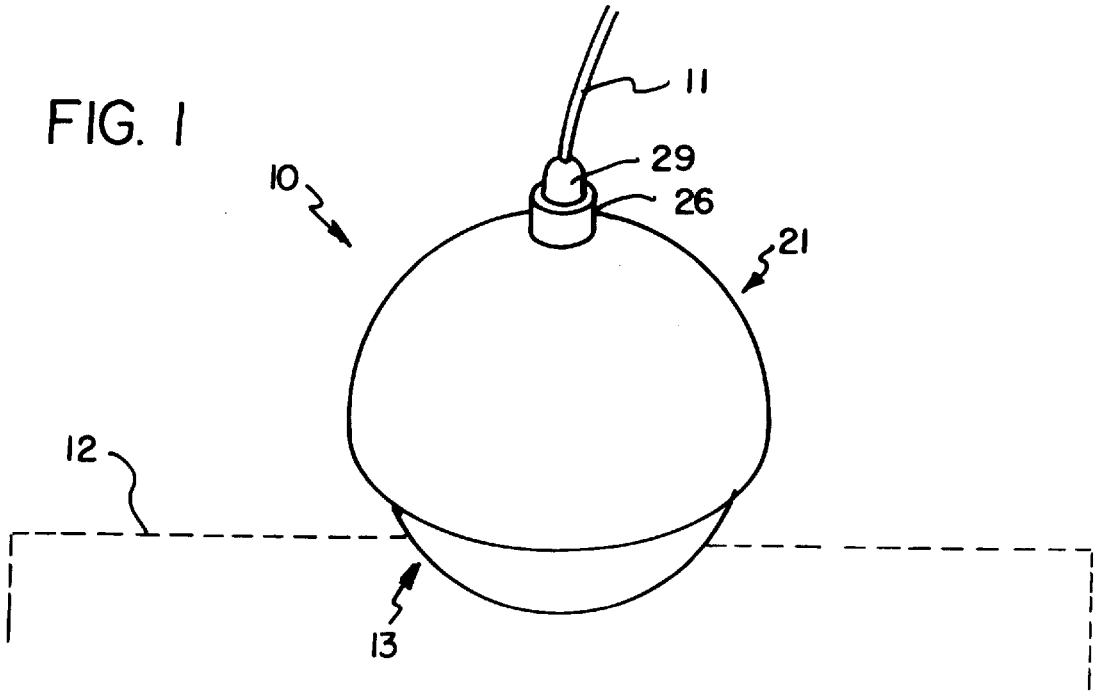
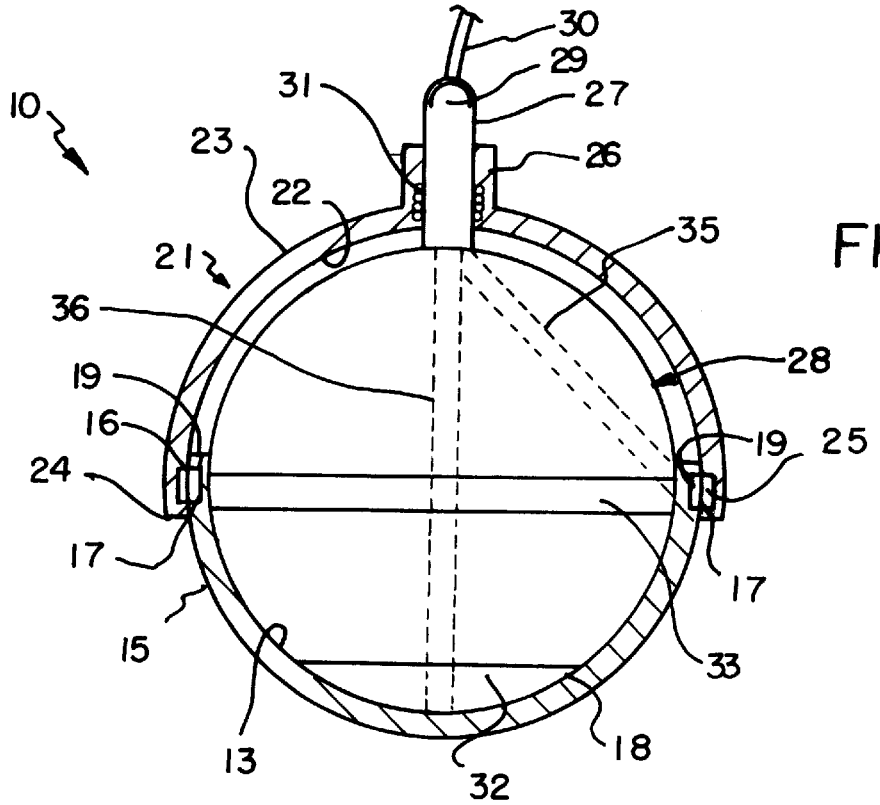
FIG. 2

ROTARY CONNECTOR

BACKGROUND OF THE INVENTION

1. Field of the Invention

The present invention relates to rotary electrical connectors and more particularly pertains to a new rotary connector for electrically connecting a set of headphones to a portable personal audio device to help prevent stress on the electrical wires of the set of headphones.

2. Description of the Prior Art

The use of rotary electrical connectors is known in the prior art. More specifically, rotary electrical connectors heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,673,228; U.S. Pat. No. 5,399,093; PCT Patent No. WO 86/03360 by Englemore; U.S. Pat. No. 3,474,376; U.S. Pat. No. 1,714,763; U.S. Pat. No. 4,699,591; and EPO Patent No. EP 0 520 603 A2 by Ditzig.

While these devices fulfill their respective, particular objectives and requirements, the aforementioned patents do not disclose a new rotary connector. The inventive device includes a substantially hemispherical jack socket defining a substantially hemispherical jack space. The outer surface of the jack socket has an annular primary contact therearound. The inner surface of the jack socket has a secondary and tertiary contacts. A resiliently deflectable top cup defines an upper space and has an interior surface with an annular first contact therearound. The top cup has an axial extent outwardly extending from the exterior surface of the top cup with an axial bore extending between the interior and exterior surfaces of the top cup. A generally spherical plug has an outwardly extending axial shaft which inserted into the axial bore of the top cup. The lower region of the plug is inserted into the jack space of the jack socket so that the plug is rotatable in the jack space of the jack socket about the center axis of the plug. The first contact of the top cap and the primary contact of the jack socket abut one another such that the first and primary contacts are in electrically communication with one another. The plug has second and third contacts which abut the secondary and tertiary contacts respectively such that the respect associated contacts are in electrically communication with one another.

In these respects, the rotary connector according to the present invention substantially departs from the conventional concepts and designs of the prior art, and in so doing provides an apparatus primarily developed for the purpose of electrically connecting a set of headphones to a portable personal audio device to help prevent stress on the electrical wires of the set of headphones.

SUMMARY OF THE INVENTION

In view of the foregoing disadvantages inherent in the known types of rotary electrical connectors now present in the prior art, the present invention provides a new rotary connector construction wherein the same can be utilized for electrically connecting a set of headphones to a portable personal audio device to help prevent stress on the electrical wires of the set of headphones.

The general purpose of the present invention, which will be described subsequently in greater detail, is to provide a new rotary connector apparatus and method which has many of the advantages of the rotary electrical connectors mentioned heretofore and many novel features that result in a new rotary connector which is not anticipated, rendered obvious, suggested, or even implied by any of the prior art rotary electrical connectors, either alone or in any combination thereof.

To attain this, the present invention generally comprises a substantially hemispherical jack socket defining a substantially hemispherical jack space. The outer surface of the jack socket has an annular primary contact therearound. The inner surface of the jack socket has a secondary and tertiary contacts. A resiliently deflectable top cup defines an upper space and has an interior surface with an annular first contact therearound. The top cup has an axial extent outwardly extending from the exterior surface of the top cup with an axial bore extending between the interior and exterior surfaces of the top cup. A generally spherical plug has an outwardly extending axial shaft which inserted into the axial bore of the top cup. The lower region of the plug is inserted into the jack space of the jack socket so that the plug is rotatable in the jack space of the jack socket about the center axis of the plug. The first contact of the top cap and the primary contact of the jack socket abut one another such that the first and primary contacts are in electrically communication with one another. The plug has second and third contacts which abut the secondary and tertiary contacts respectively such that the respect associated contacts are in electrically communication with one another.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new rotary connector apparatus and method which has many of the advantages of the rotary electrical connectors mentioned heretofore and many novel features that result in a new rotary connector which is not anticipated, rendered obvious, suggested, or even implied by any of the prior art rotary electrical connectors, either alone or in any combination thereof.

It is another object of the present invention to provide a new rotary connector which may be easily and efficiently manufactured and marketed.

It is a further object of the present invention to provide a new rotary connector which is of a durable and reliable construction.

An even further object of the present invention is to provide a new rotary connector which is susceptible of a low cost of manufacture with regard to both materials and labor, and which accordingly is then susceptible of low prices of sale to the consuming public, thereby making such rotary connector economically available to the buying public.

Still yet another object of the present invention is to provide a new rotary connector which provides in the apparatuses and methods of the prior art some of the advantages thereof, while simultaneously overcoming some of the disadvantages normally associated therewith.

Still another object of the present invention is to provide a new rotary connector for electrically connecting a set of headphones to a portable personal audio device to help prevent stress on the electrical wires of the set of headphones.

Yet another object of the present invention is to provide a new rotary connector which includes a substantially hemispherical jack socket defining a substantially hemispherical jack space. The outer surface of the jack socket has an annular primary contact therearound. The inner surface of the jack socket has a secondary and tertiary contacts. A resiliently deflectable top cup defines an upper space and has an interior surface with an annular first contact therearound. The top cup has an axial extent outwardly extending from the exterior surface of the top cup with an axial bore extending between the interior and exterior surfaces of the top cup. A generally spherical plug has an outwardly extending axial shaft which inserted into the axial bore of the top cup. The lower region of the plug is inserted into the jack space of the jack socket so that the plug is rotatable in the jack space of the jack socket about the center axis of the plug. The first contact of the top cap and the primary contact of the jack socket abut one another such that the first and primary contacts are in electrically communication with one another. The plug has second and third contacts which abut the secondary and tertiary contacts respectively such that the respect associated contacts are in electrically communication with one another.

Still yet another object of the present invention is to provide a new rotary connector that prevents wear and tear on the electrical cord of a set of headphones by permitting rotation of the electrical cord plug in the jack of the portable personal audio device.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic perspective view of a new rotary connector according to the present invention.

FIG. 2 is a schematic partial breakaway view of the present invention.

DESCRIPTION OF THE PREFERRED EMBODIMENT

Figure 3:
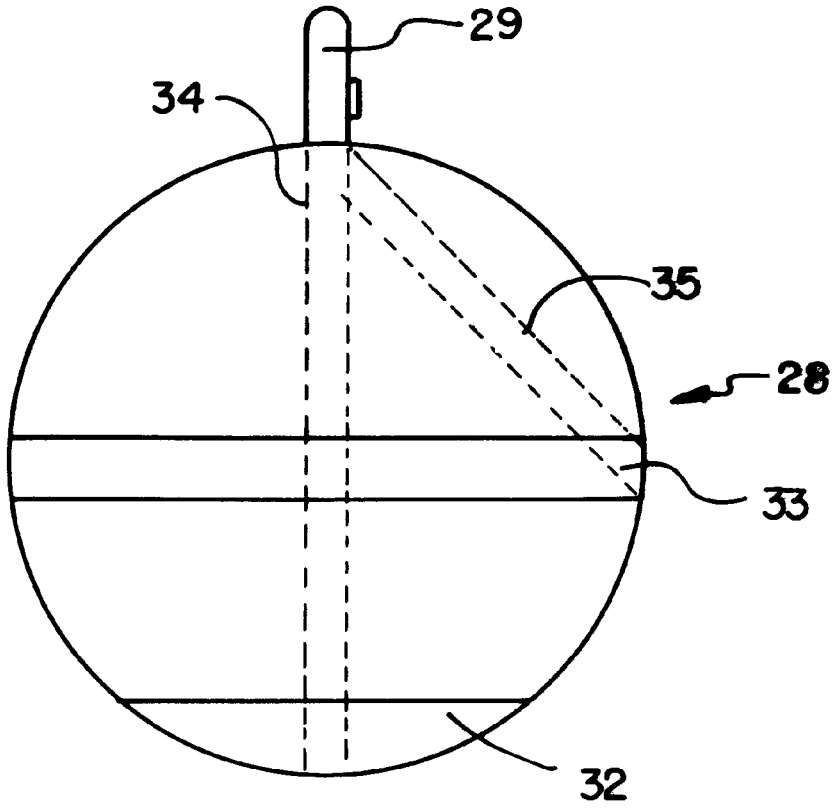
FIG. 3 is a schematic side view of the plug of the present invention.
Figure 4:
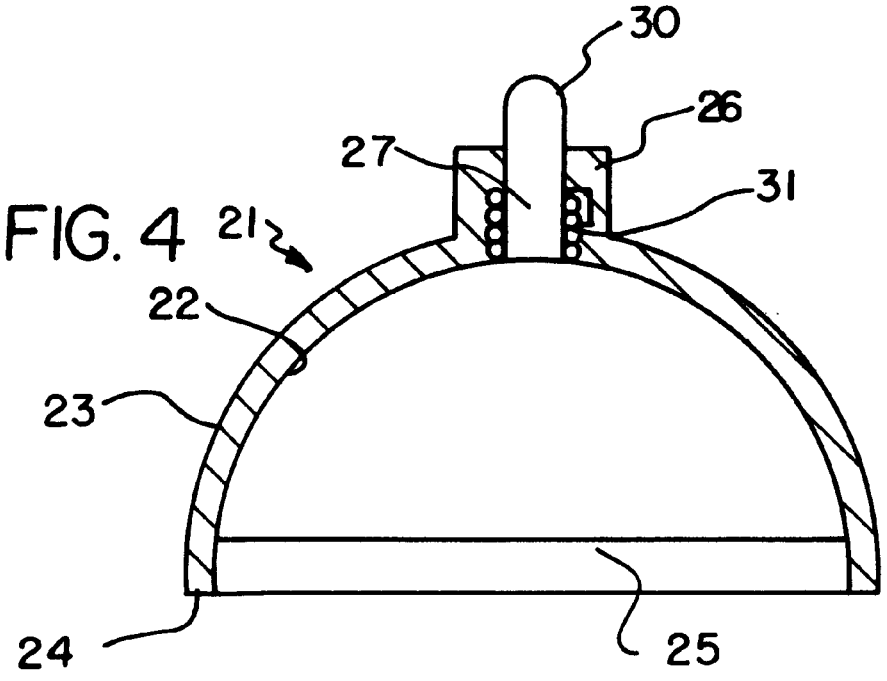
FIG. 4 is a schematic cross-sectional view of the top cap of the present invention.
Figure 5:
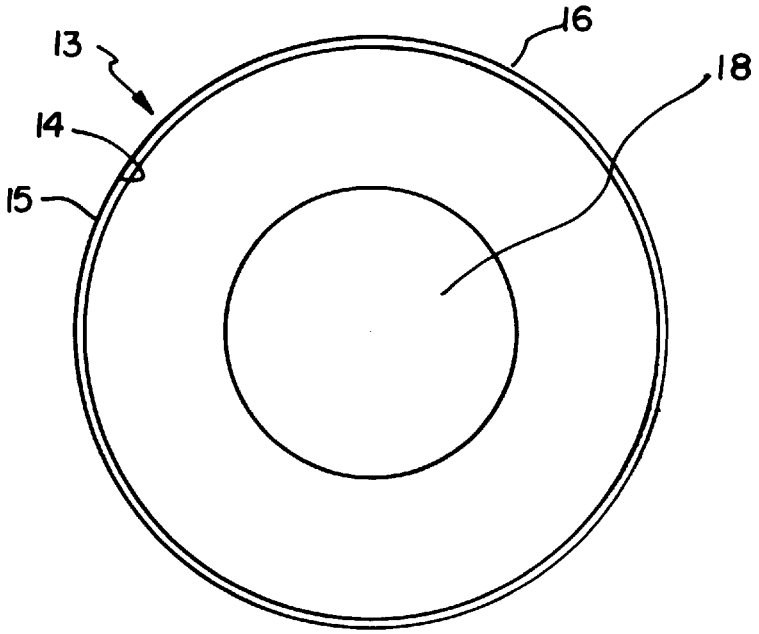
FIG. 5 is a schematic top view of the jack socket of the present invention.
Figure 6:
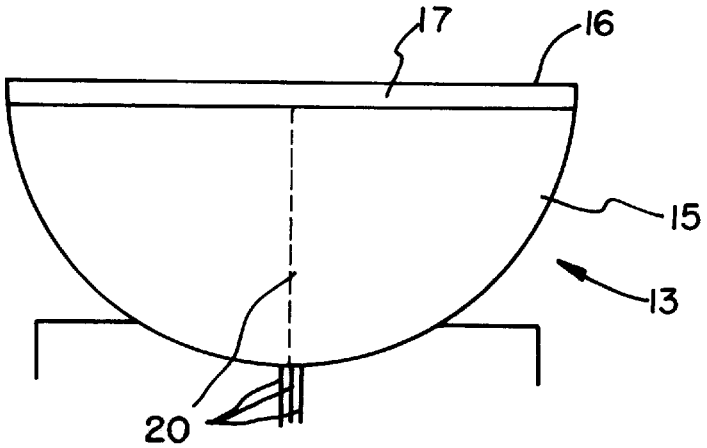
FIG. 6 is a schematic side view of the jack socket of the present invention.
Figure 7:
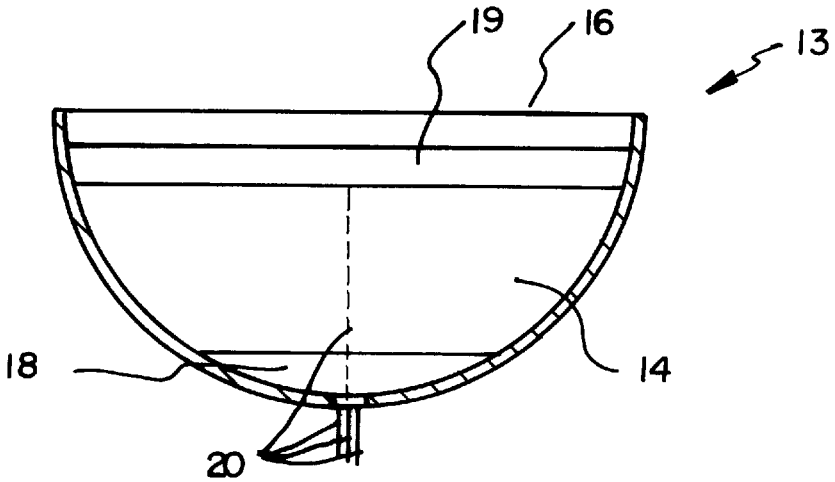
FIG. 7 is a schematic cross-sectional view of the jack socket of the present invention.

With reference now to the drawings, and in particular to FIGS. 1 through 7 thereof, a new rotary connector embodying the principles and concepts of the present invention and generally designated by the reference numeral 10 will be described.

As best illustrated in FIGS. 1 through 7, the rotary connector 10 generally comprises a substantially hemispherical jack socket defining a substantially hemispherical jack space. The outer surface of the jack socket has an annular primary contact therearound. The inner surface of the jack socket has a secondary and tertiary contacts. A resiliently deflectable top cup defines an upper space and has an interior surface with an annular first contact therearound. The top cup has an axial extent outwardly extending from the exterior surface of the top cup with an axial bore extending between the interior and exterior surfaces of the top cup. A generally spherical plug has an outwardly extending axial shaft which inserted into the axial bore of the top cup. The lower region of the plug is inserted into the jack space of the jack socket so that the plug is rotatable in the jack space of the jack socket about the center axis of the plug. The first contact of the top cap and the primary contact of the jack socket abut one another such that the first and primary contacts are in electrically communication with one another. The plug has second and third contacts which abut the secondary and tertiary contacts respectively such that the respect associated contacts are in electrically communication with one another.

In closer detail, the rotary connector system 10 is designed for detachably connecting an electrical cord 11 of a set of headphones to a portable personal audio device 12. Specifically, the rotary connector system comprises a substantially hemispherical jack socket 13 with inner and outer surfaces 14,15, a substantially circular upper rim 16, and a bottom region distal the upper rim of the jack socket. The inner surface of the jack socket defines a substantially hemispherical jack space and the upper rim of the jack socket defines an upper opening into the jack space. The jack socket is preferably provided in an audio device so that the upper rim of the jack socket outwardly extends from the audio device.

The outer surface of the jack socket has an annular primary contact 17 therearound. The primary contact of the jack socket is positioned adjacent the upper rim of the jack socket. The inner surface of the jack socket has a secondary contact 18 positioned in the bottom region of the jack socket. The secondary contact of the jack socket is a generally inverted dome shape and has a generally circular outer perimeter. The inner surface of the jack socket also has an annular tertiary contact 19 therearound. The tertiary contact of the jack socket is positioned towards and spaced apart from the upper rim of the jack socket. Ideally, the upper rim of the jack socket and the tertiary contact define an arc therebetween has an angle taken from a center axis of the jack socket of about 10 degrees. In this idea embodiment, the primary and tertiary contacts and the outer perimeter of the secondary contact lie in generally parallel planes with one another. The primary, secondary, and tertiary contacts is electrically connected by wiring 20 to the audio device.

The resiliently deflectable dome-shaped top cup 21 has interior and exterior surfaces 22,23, a lower rim 24, and a top region. The top cup is preferably shaped to encompass an area greater than a hemisphere of a sphere defined by an radius of curvature of the top cup. The interior surface of the top cup defines an upper space with the lower rim of the top cup defining a lower opening into upper space of the top cup.

The interior surface of the top cup has an annular first contact 25 therearound positioned adjacent the lower rim of the top cup. The top cup has a generally cylindrical axial extent 26 outwardly extending from the exterior surface of the top cup. The axial extent of the top cup is positioned in the top region of the top cup. The axial extent of the top cup has a generally cylindrical axial bore 27 therethrough between the interior and exterior surfaces of the top cup.

The generally spherical plug 28 has upper and lower regions, a center axis, and an equator. The plug has an outwardly extending axial shaft 29 positioned in the upper region of the plug. The upper region of the plug is positioned in the upper space of the top cap with the axial shaft of the plug is inserted into the axial bore of the top cup so that the top of the axial shaft abuts a wire 30 extending above the axial bore and electrically connected to the first contact. The axial shaft of the plug is also preferably coupled to the top cap by a coupler in the axial bore of the axial extent of the top cap to hold the plug against rotation with respect to the top cap.

The lower region of the plug is inserted into the jack space of the jack socket so that the plug is rotatable in the jack space of the jack socket about the center axis of the plug. Additionally, the first contact of the top cap and the primary contact of the jack socket abut one another such that the first and primary contacts are in electrically communication with one another. Preferably the plug and the jack socket are generally coaxially aligned with one another and the upper rim of the jack socket and the equator of the plug generally coplanar with one another. The upper rim of the jack socket and an adjacent portion of the jack socket is inserted into the lower space of the top cap such that the upper rim of the jack socket and the adjacent portion of the jack socket are interposed between the plug and the top cup. The adjacent portion of the jack socket deflects a portion of top cap adjacent the lower rim of the top cap outwards such that the adjacent portion of the jack socket is held between the plug and the deflected portion of the top cap.

The plug has a second contact 32 positioned in the lower region of the plug. The second contact of the plug is a generally inverted dome shape and has a generally circular outer perimeter. The plug also has an annular third contact 33 therearound. The third contact of the plug is positioned adjacent the equator of the plug on the lower hemisphere of the plug. Preferably, the first and third contacts and the outer perimeter of the second contact lie in generally parallel planes with one another.

The second contact of the plug and the secondary contact of the jack socket abut one another such that the second and secondary contacts are in electrically communication with one another. Preferably, the outer perimeters of the second and secondary contacts lie in generally parallel planes to one another. Ideally, the outer perimeters of the second and secondary contacts lie in generally common plane with one another. Similarly, the third contact of the plug and the tertiary contact of the jack socket abut one another such that the third and tertiary contacts are in electrically communication with one another. Preferably, the third and tertiary contacts lie in generally parallel planes to one another.

The axial shaft of the plug is coupled to the electrical cord of a set of headphones with the first, second, and third contacts electrically connected to the electrical cord of the set of headphones by an electrical conduit in the top cup for the first contact and a pair of electrical conduits 34,35 in the plug for the second and third contacts.

In use, the first and primary, the second and secondary, and the third and tertiary contacts remain in contact with one another as the plug is rotated in the lower space about the center axis of the plug to maintain electrical communication between the set of headphones and the audio device.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A rotary connector system, comprising:

a substantially hemispherical jack socket having inner and outer surfaces, a substantially circular upper rim, and a bottom region distal said upper rim of said jack socket;

said inner surface of said jack socket defining a substantially hemispherical jack space, said upper rim of said jack socket defining an upper opening into said jack space;

said outer surface of said jack socket having an annular primary contact therearound;

said inner surface of said jack socket having a secondary contact positioned in said bottom region of said jack socket;

said inner surface of said jack socket having an annular tertiary contact therearound;

a resiliently deflectable dome-shaped top cup having interior and exterior surfaces, a lower rim, and a top region;

said interior surface of said top cup defining an upper space, said lower rim of said top cup defining a lower opening into upper space of said top cup;

said interior surface of said top cup having an annular first contact therearound;

said top cup having an axial extent outwardly extending from said exterior surface of said top cup;

said axial extent of said top cup having an axial bore therethrough between said interior and exterior surfaces of said top cup;

a generally spherical plug having upper and lower regions, a center axis, and an equator;

said plug having an outwardly extending axial shaft;

said upper region of said plug being positioned in said upper space of said top cap, said axial shaft of said plug being inserted into said axial bore of said top cup;

said lower region of said plug being inserted into said jack space of said jack socket;

said upper rim of said jack socket and an adjacent portion of said jack socket being inserted into said lower space of said top cap such that said upper rim of said jack socket and said adjacent portion of said jack socket are interposed between said plug and said top cup;

said plug being rotatable in said jack space of said jack socket about said center axis of said plug;

said first contact of said top cap and said primary contact of said jack socket abutting one another such that said first and primary contacts are in electrically communication with one another;

said plug having a second contact positioned in said lower region of said plug;

said second contact of said plug and said secondary contact of said jack socket abutting one another such that said second and secondary contacts are in electrically communication with one another;

said plug having an annular third contact therearound; and said third contact of said plug and said tertiary contact of said jack socket abutting one another such that said third and tertiary contacts are in electrically communication with one another.

2. The rotary connector system of claim 1, wherein said jack socket is provided in an audio device, said upper rim of said jack socket outwardly extending from the audio device, said primary, secondary, and tertiary contacts being electrically connected to the audio device.

3. The rotary connector system of claim 2, wherein said axial shaft of said plug is coupled to an electrical cord of a set of headphones, and wherein said first, second, and third contacts are electrically connected to said electrical cord of said set of headphones.

4. The rotary connector system of claim 1, wherein said primary contact of said jack socket is positioned adjacent said upper rim of said jack socket, and wherein said first contact of said top cup is positioned adjacent said lower rim of said top cup.

5. The rotary connector system of claim 4, wherein aid tertiary contact of said jack socket is positioned towards and spaced apart from said upper rim of said jack socket, and wherein third contact of said plug is positioned adjacent said equator of said plug.

6. The rotary connector system of claim 5, wherein said upper rim of said jack socket and said tertiary contact defining an arc therebetween having an angle taken from a center axis of said jack socket of about 10 degrees.

7. The rotary connector system of claim 1, wherein said primary and tertiary contacts and said outer perimeter of said secondary contact lie in generally parallel planes with one another.

8. The rotary connector system of claim 1, wherein said top cup is shaped to encompass an area greater than a hemisphere of a sphere defined by an radius of curvature of said top cup.

9. A rotary connector system for detachably connecting an electrical cord of a set of headphones to a portable personal audio device, said rotary connector system comprising:

a substantially hemispherical jack socket having inner and outer surfaces, a substantially circular upper rim, and a bottom region distal said upper rim of said jack socket;

said inner surface of said jack socket defining a substantially hemispherical jack space, said upper rim of said jack socket defining an upper opening into said jack space;

said jack socket being provided in an audio device, said upper rim of said jack socket outwardly extending from the audio device;

said outer surface of said jack socket having an annular primary contact therearound, said primary contact of said jack socket being positioned adjacent said upper rim of said jack socket;

said inner surface of said jack socket having a secondary contact positioned in said bottom region of said jack socket, said secondary contact of said jack socket having a generally circular outer perimeter;

said inner surface of said jack socket having an annular tertiary contact therearound, said tertiary contact of said jack socket being positioned towards and spaced apart from said upper rim of said jack socket;

wherein said upper rim of said jack socket and said tertiary contact defining an arc therebetween having an angle taken from a center axis of said jack socket of about 10 degrees;

said primary and tertiary contacts and said outer perimeter of said secondary contact lying in generally parallel planes with one another;

said primary, secondary, and tertiary contacts being electrically connected to the audio device;

a resiliently deflectable dome-shaped top cup having interior and exterior surfaces, a lower rim, and a top region;

said top cup being shaped to encompass an area greater than a hemisphere of a sphere defined by an radius of curvature of said top cup;

said interior surface of said top cup defining an upper space, said lower rim of said top cup defining a lower opening into upper space of said top cup;

said interior surface of said top cup having an annular first contact therearound, said first contact of said top cup being positioned adjacent said lower rim of said top cup;

said top cup having a generally cylindrical axial extent outwardly extending from said exterior surface of said top cup, said axial extent of said top cup being positioned in said top region of said top cup;

said axial extent of said top cup having a generally cylindrical axial bore therethrough between said interior and exterior surfaces of said top cup;

a generally spherical plug having upper and lower regions, a center axis, and an equator;

said plug having an outwardly extending axial shaft positioned in said upper region of said plug;

said upper region of said plug being positioned in said upper space of said top cap, said axial shaft of said plug being inserted into said axial bore of said top cup, said axial shaft of said plug being coupled to said top cap in said axial extent of said top cap to hold said plug against rotation with respect to said top cap;

said lower region of said plug being inserted into said jack space of said jack socket, said plug and said jack socket being generally coaxially aligned with one another, said upper rim of said jack socket and said equator of said plug being generally coplanar;

said upper rim of said jack socket and an adjacent portion of said jack socket being inserted into said lower space of said top cap such that said upper rim of said jack socket and said adjacent portion of said jack socket are interposed between said plug and said top cup;

said adjacent portion of said jack socket deflecting a portion of top cap adjacent said lower rim of said top cap outwards such that said adjacent portion of said jack socket is held between said plug and said deflected portion of said top cap;

said plug being rotatable in said jack space of said jack socket about said center axis of said plug;

said first contact of said top cap and said primary contact of said jack socket abutting one another such that said first and primary contacts are in electrically communication with one another;

said plug having a second contact positioned in said lower region of said plug, said second contact of said plug having a generally circular outer perimeter;

said plug having an annular third contact therearound, said tertiary contact of said jack socket being positioned adjacent said equator of said plug;

said first and third contacts and said outer perimeter of said second contact lying in generally parallel planes with one another;

said second contact of said plug and said secondary contact of said jack socket abutting one another such that said second and secondary contacts are in electrically communication with one another;

wherein said outer perimeters of said second and secondary contacts lie in generally parallel planes to one another;

said third contact of said plug and said tertiary contact of said jack socket abutting one another such that said third and tertiary contacts are in electrically communication with one another;

wherein said third and tertiary contacts lie in generally parallel planes to one another;

said axial shaft of said plug being coupled to an electrical cord of a set of headphones; and said first, second, and third contacts being electrically connected to said electrical cord of said set of headphones by an electrical conduit in the top cup for the first contact and a pair of electrical conduits in the plug for the second and third contacts.

* * * * *